US005560317A

United States Patent [19]

Bunyan et al.

[11] Patent Number: 5,560,317

[45] Date of Patent: Oct. 1, 1996

[54] MECHANISM TO DISPENSE MEDICATION TO ANIMALS

[75] Inventors: Glen W. Bunyan, Kanwal; Anthony I. Burrell, Avoca Beach; Darryl R. Whitford, Government Road, Rosedale, South Australia, all of Australia

[73] Assignees: N J Phillips Pty Limited, Somersby; Darryl Ross Whitford, Rosedale, both of Australia

[21] Appl. No.: 573,868

[22] Filed: Dec. 18, 1995

Related U.S. Application Data

[63] Continuation of Ser. No. 326,184, Oct. 19, 1994, abandoned.

[51] Int. Cl.[6] ..... A61D 7/00

[52] U.S. Cl. ..... 119/174; 119/656; 604/246

[58] Field of Search ..... 119/174, 158, 119/159; 4/597, 604; 604/246; 128/200.11

[56] References Cited

U.S. PATENT DOCUMENTS

| | | | |
|---|---|---|---|
| 3,529,577 | 9/1970 | McMenemy, Jr. | 119/159 |
| 3,699,928 | 10/1972 | Cowan | 119/159 |
| 4,379,440 | 4/1983 | Thedford et al. | 119/159 |
| 4,589,372 | 5/1986 | Smith | 119/55 X |
| 4,729,135 | 3/1988 | Titterington | 4/597 |
| 4,887,554 | 12/1989 | Whitford | 119/159 |

*Primary Examiner*—Robert P. Swiatek
*Assistant Examiner*—Elizabeth Shaw
*Attorney, Agent, or Firm*—Ladas & Parry

[57] ABSTRACT

A mechanism to dispense a variety of medications to an animal. The mechanism includes a pump 14 which when operated delivers a dose of medication of predetermined volume to an associated dispenser 16, There is a plurality of pumps 14 each having an associated dispenser 16, Each dispenser 16, when operated, activates a control unit 13 which in turn activates the associated pump 14 so that a dose of predetermined volume is delivered to the dispenser 16.

6 Claims, 2 Drawing Sheets

MECHANISM TO DISPENSE MEDICATION TO ANIMALS

This application is a continuation of application Ser. No. 8/326,184 filed on Oct. 19, 1994, now abandoned.

TECHNICAL FIELD

The present invention relates to devices to administer medication to animals.

BACKGROUND OF THE INVENTION

Described in Australian Patent 605296 is an animal drench device which dispenses a quantity of medication to an animal, the size of the dose being determined by the weight of the animal. The mechanism includes a means of determining the weight of the animal which means then interacts with an injector which delivers a dose, the volume or weight of which is determined by the weight of the animal.

It is desirable to be able to monitor the health of any animal and to determine when certain medications were delivered to that animal. Such monitoring would include weighing the animal at preferably regular intervals.

SUMMARY OF THE INVENTION

There is disclosed herein a mechanism to dispense medication to an animal, said mechanism comprising:

- means to determine the weight of the animal and to generate a signal indicative of the weight;
- a control unit to receive said weight signal and being adapted to generate a plurality of command signals, said command signals having a characteristic determined by said weight signal;
- a plurality of pump means each being adapted to receive and deliver under pressure a medication dose, each pump means being further adapted to receive a particular one of said command signals and to determine the size of said dose in accordance with said characteristic so that the dose size is determined by the weight of the animal; and
- a plurality of dispensers each being associated with a particular pump means so as to receive a dose therefrom and adapted to deliver the dose to the animal.

Preferably, the control unit would receive information so that the animal is identified. The control unit would recognise the animal and record the animal's weight and further record what medication had been dispensed at that time. As a further example, each animal could have a tag as a means of identifying that particular animal. That tag could be provided with a bar code or other information which would enable a signal to be generated and sent to the control unit so that the control unit could identify the animal.

BRIEF DESCRIPTION OF THE DRAWINGS

A preferred form of the present invention will now be described by way of example with reference to the accompanying drawings wherein.

DETAILED DESCRIPTION OF THE PREFERRED EMBODIMENT

Figure 1:
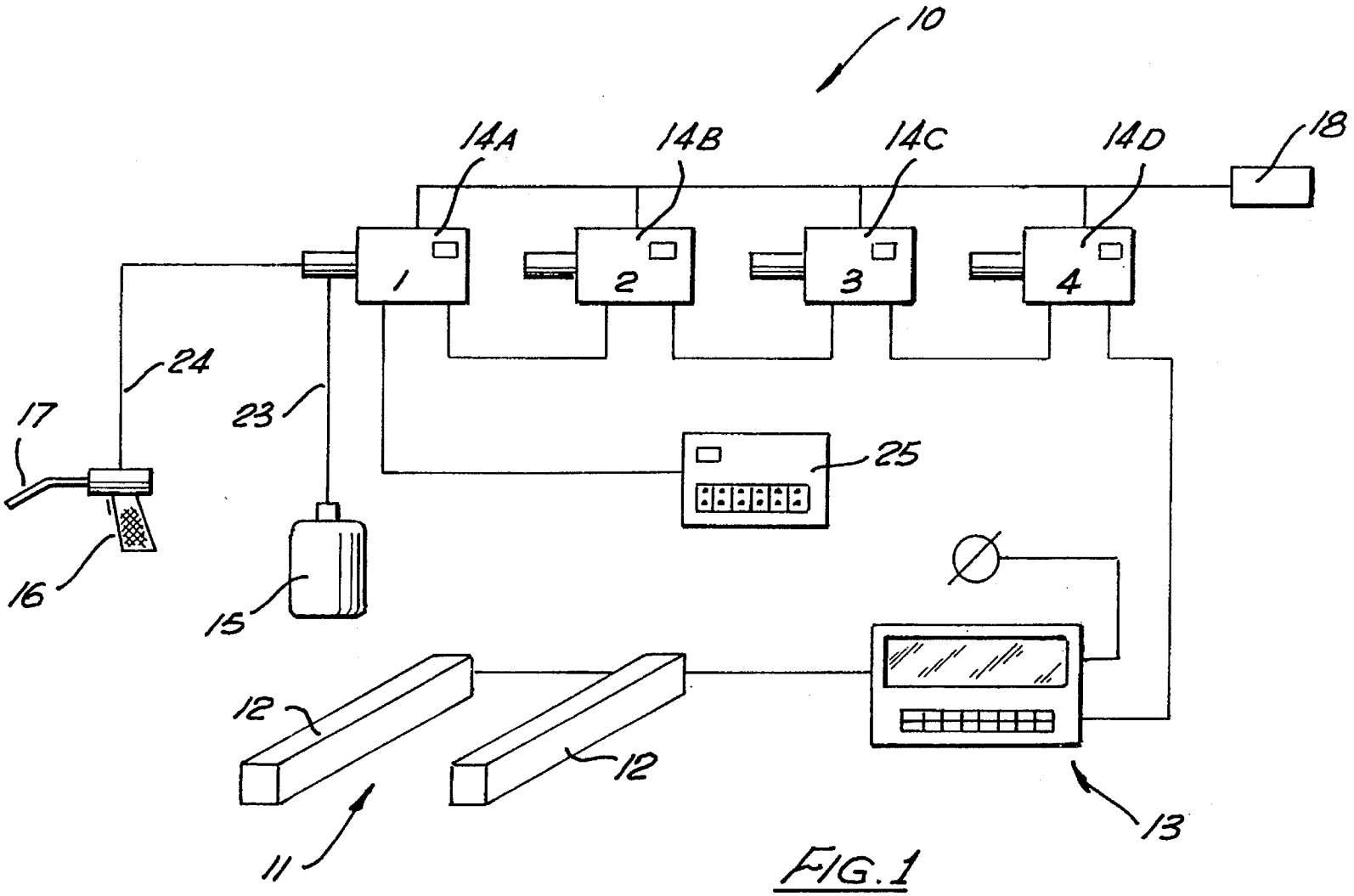
FIG. 1 is a schematic illustration of a mechanism to deliver medication to an animal.
Figure 2:
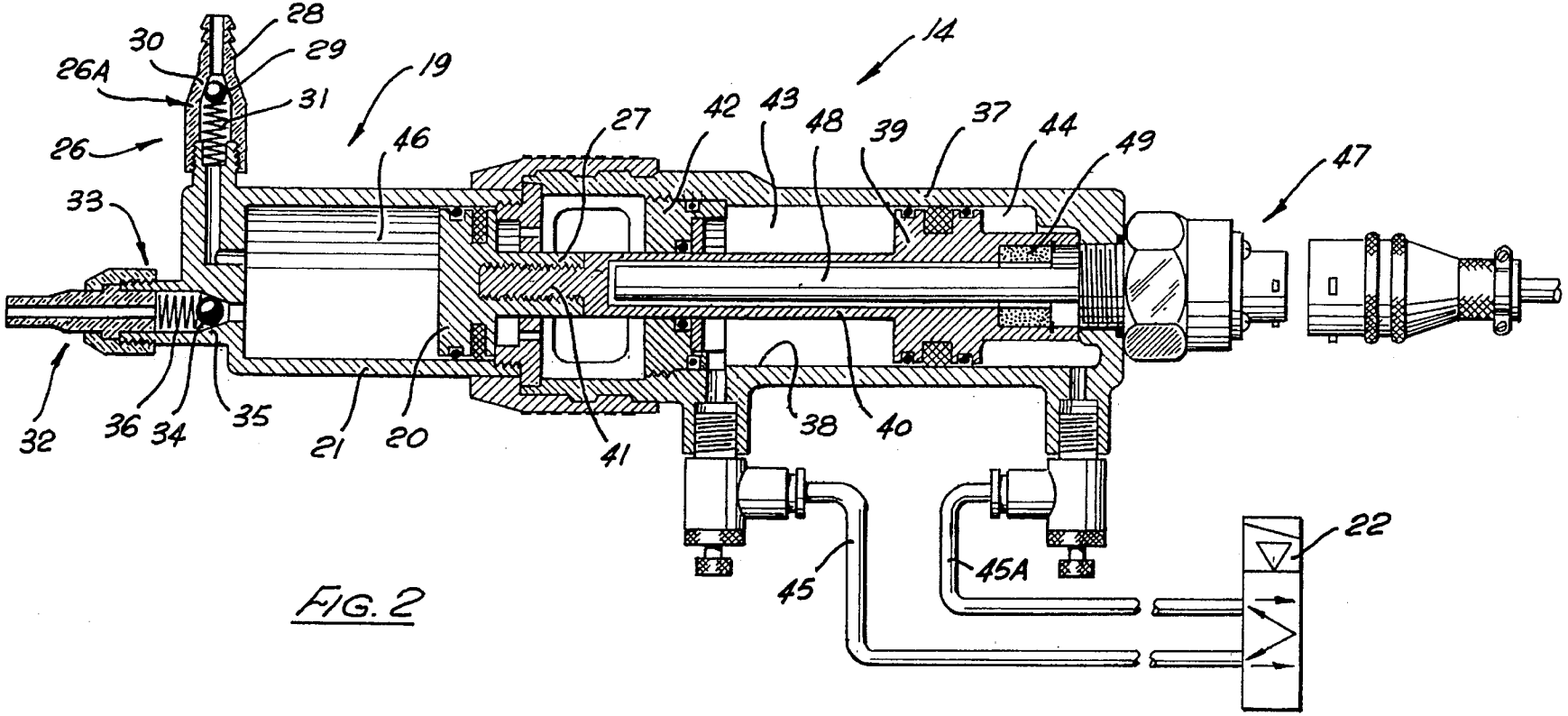
FIG. 2 is a schematic side elevation of a pump assembly to deliver a medication having a predetermined dose size.

In the accompanying drawings there is schematically depicted a mechanism 10 to dispense a variety of medications to an animal. The mechanism 10 includes a weighing means 11 to weigh an animal and W generate a signal indicative of the weight of the animal. In this embodiment, the weighing means 11 includes a pair of weight transducers 12 which would support the anal, preferably by a platform upon which the animal stands. The weight transducers 12 produce a signal indicative of the weight of the animal, which signal is delivered to a control unit 13.

The control unit 13 would then generate a plurality of command signals to be delivered to a series of pump assemblies 14. The command signals would have a characteristic indicative of the weight of the animal, with each command signal being delivered to a particular one of the pumps 14.

Each pump 14 would be individually connected to a respective supply 15 of medication to be dispensed by the pump 14 associated therewith. For example, the pump 14(A) would be connected to a supply 15 having a particular medication. It would draw from the supply 15 a dose size dictated by the command signal received from the control unit 13. The pump unit 14(A) would then deliver the dose under pressure to a dispenser 16. In this particular embodiment, the dispenser 16 is hand held and is merely provided with a button which when activated sends a signal to the control unit 13 to activate the pump 14. The injector nozzle may merely be a tube which is placed into the mouth of the animal, or alternatively a syringe needle. As a further alternative, the dispenser 16 may deliver a spray to the skin of the animal or to apply the dose in some other manner.

It should be appreciated that the pumps 14(B), (C) and (D) are each associated with their own particular reservoir 15.

In this embodiment, the pumps 14 receive air under pressure from a compressor means 18. Other drives for the pumps 14 could also be used. For example the pumps 14 could be driven by other compressed gas or even hydraulic fluid. As a still further alternative electric servo motor could be employed.

Each pump 14 would include an interacting piston and cylinder assembly 19, with the piston 20 being moved relative to the cylinder 21 to determine the size of the dose to be dispensed. An air delivery control valve 22 would receive the command signal from the control unit 13 and control delivery of the air under pressure from the compressor 18 to the pumps 14 in order to regulate movement of the piston rod 27 and therefore the size of the dose delivered. The cylinder 21 has an inlet connection 26 including a one-way valve 26A. Medication would be drawn into the cylinder 21 through the one-way valve 26A. The one-way valve 26A includes a body 28 housing a movable spherical valve element 29 biased against a seat 30 by means of a spring 31. Extending from the cylinder 21 is an outlet connection 32. The outlet connection 32 includes a one-way valve 33 including a spherical valve element 34 biased against a valve seat 35 by means of a spring 36.

The piston 20 includes a drive mechanism consisting of a hollow housing 37 providing an internal cylindrical surface 38 which cooperates with a double sided piston 39. Extending from the piston 39 is a piston rod 40 which is connected to the piston rod 27 so as to cause reciprocation thereof. More particularly, the extremity 41 of the piston rod 40 is threadably engaged within the piston rod 27 so as to be fixed thereto. A seal assembly 42 extends between the housing 37 and the piston rod 40 so that the piston rod may sealingly slide therethrough. The cylindrical surface 38, seal assembly 42 and piston 49 co-operate to define a variable volume chamber 43. The other end of the housing 37, remote from the piston 20, is closed so that the cylindrical surface 38 and piston 39 co-operate to provide a further variable volume chamber 44. Extending to the chamber 43 is at an air delivery line 45 which extends from the valve 22. Extending to the chamber 44 is a further air delivery line 45 which also extends from a port of the valve 22. The valve 22 co-ordinates air flow to and from the chambers 43 and 44. When air is delivered to the chamber 44 and air permitted to exhaust from the chamber 43, the piston 39 moves towards the cylinder 21 and therefore moves the piston 20 to reduce the volume of the chamber 46 so as to force medication to exit via the outlet connection 32 for delivery to the dispenser 16. When air is delivered to the chamber 43 and air permitted to exhaust from the chamber 44, the piston 39 moves away from the cylinder 21 therefore increasing the size of the chamber 46. Medication is therefore drawn into the chamber 46 by the inlet connection 26. The one way valves 26 and 33 co-ordinate the flow so that medication only exits via the outlet connection 32 and is only drawn in by the inlet connection 26.

Mounted at the closed end of the housing 37 is an IC series rectilinear displacement transducer 47. The transducer 47 includes a rod 48 along which a coil 49 is moved, by being mounted with the piston 39. An alternating current is delivered to the coil 49 with the current passing through the coil 49 being determined by its position along the rod 48. Therefore, the position of the piston 39 can be determined and therefore the position of the piston 20 can be determined. The coil 49 is connected to the control unit 13. The control unit 13 controls the valve 22 and therefore controls movement of the piston 39. By controlling the movement and displacement of the piston 39, the size of the dose of medication is controlled. The valve 22 is a five port solenoid valve.

Attached to the cylinder 21 is a supply line 23, via the inlet connection 26, which extends to the supply 15, and a delivery line 24 which extends to the dispenser 16 via the oulet connection 32.

A control panel 25 is provided with indicators providing an operator with visual signals so that the operator knows the "condition" or phase of operation of each of the pumps 14.

Preferably, each of the dispensers 16 would be provided with a light or other indicator providing the operator with a signal informing the operator that the particular dispenser 16 needs to be operated. For example, a particular animal may only require a single medication while another animal may require two or more medications. In such instances, one or more of the dispensers 16 would be activated.

The control unit 13 would be used to store information in respect of each animal. Preferably, each animal would be provided with a "tag" (or other means of identifying the animal) which "tag" would be read and the information delivered electronically to the control unit 13 so that the animal is identified. The control unit would then be programmed to indicate to tile operator which dispensers 16 are to be manipulated and would govern the dosage size to be delivered from the dispenser 16.

What we claim is:

1. There is disclosed herein a mechanism to dispense medication to an animal, said mechanism comprising:

means to determine the weight of the animal and to generate a signal indicative of the weight;

a control unit to receive said weight signal and being adapted to generate a plurality of command signals, said command signals having a characteristic determined by said weight signal;

a plurality of pump means each being adapted to receive and deliver under pressure a medication dose, each pump means being further adapted to receive a particular one of said command signals and to determine the size of said dose in accordance with said characteristic so that the dose size is determined by the weight of the animal; and a plurality of dispensers each being associated with a particular pump means so as to receive a dose therefrom and adapted to deliver the dose to the animal.

2. The mechanism of claim 1, wherein each pump means includes an interacting dose piston and dose cylinder defining a variable volume chamber through which medication passes to be delivered to the associated dispenser, and displacement means to control the relative displacement between the dose piston and dose cylinder to thereby regulate the volume of the dose being delivered.

3. The mechanism of claim 2, wherein said displacement means includes a further co-operating piston and cylinder and a transducer associated therewith to provide a signal indicative of the position of said further piston with respect to said further cylinder to thereby provide a single signal indicative of the position of said dose piston with respect to said dose cylinder, the transducer signal being delivered to said control unit, said mechanism further including valve means to regulate the delivery of a working fluid to said further cylinder to cause relative movement between said further piston and further cylinder, said valve means being operatively associated with said control unit so that said control unit determines the relative movement between said further piston and said further cylinder to thereby regulate the dose delivered by the pump means to the associated dispenser.

4. The mechanism of claim 3, wherein said further piston is a double sided piston and said further piston co-operates with said further cylinder to define a pair of variable volume chambers, the chambers being located on opposite sides of said further piston, said mechanism further including a first fluid line to deliver a working fluid under pressure to a first one of said pair of chambers, said first fluid line extending to said valve means, a second fluid line extending from said valve means, said second fluid line extending to the second one of said pair of chambers to deliver the working fluid thereto.

5. The mechanism of claim 1, wherein each dispenser is provided with an electrical switch, which electrical switch provides a signal for said control unit to cause operation of said control unit to activate the associated pump means to deliver a dose to the associated dispenser.

6. The mechanism of claim 1, wherein each dispenser is provided with a switch which activates said control until which in turn activates the pump associated with said switch, and wherein each dispenser further includes indicator means to indicate to an operator which of the dispensers are to be used.

* * * * *